US007091908B2

(12) United States Patent
Fabrega-Sanchez

(10) Patent No.: US 7,091,908 B2
(45) Date of Patent: Aug. 15, 2006

(54) PRINTED MONOPOLE MULTI-BAND ANTENNA

(75) Inventor: Jorge Fabrega-Sanchez, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 60 days.

(21) Appl. No.: 10/838,416

(22) Filed: May 3, 2004

(65) Prior Publication Data

US 2005/0242998 A1 Nov. 3, 2005

(51) Int. Cl.
*H01Q 1/38* (2006.01)

(52) U.S. Cl. ..... 343/700 MS; 343/702; 343/893

(58) Field of Classification Search ..... 343/700 MS
See application file for complete search history.

(56) References Cited

U.S. PATENT DOCUMENTS 4,835,541 A * 5/1989 Johnson et al. ..... 343/713
4,980,694 A 12/1990 Hines
5,337,061 A 8/1994 Pye et al.
6,184,844 B1 * 2/2001 Filipovic et al. ..... 343/895
6,326,921 B1 12/2001 Egorov et al.
6,480,162 B1 * 11/2002 Sabet et al. ..... 343/767
6,529,749 B1 * 3/2003 Hayes et al. ..... 455/575.7
6,917,346 B1 * 7/2005 Izzat et al. ..... 343/895
6,943,733 B1 * 9/2005 Vance ..... 343/700 MS

* cited by examiner

*Primary Examiner*—Wilson Lee
*Assistant Examiner*—Binh Van Ho

(57) ABSTRACT

An exemplary printed monopole multi-band antenna comprises a common radiator element, a first radiator arm connected to the common radiator element and a second radiator arm connected to the common radiator element. Electromagnetic coupling between the first radiator arm and the second radiator arm contributes to and/or shifts the resonance of the first radiator arm and the second radiator arm, thereby allowing the multi-band antenna to be tuned such that the first radiator arm is capable of resonating at a first frequency range and at a second frequency range, and the second radiator arm is capable of resonating at a third frequency range.

20 Claims, 3 Drawing Sheets

PRINTED MONOPOLE MULTI-BAND ANTENNA

BACKGROUND OF THE INVENTION

1. Field of the Invention

The present invention relates to the field of wireless communication devices. More specifically, the invention relates to antennas for wireless communication devices.

2. Related Art

A typical wireless communication device, such as a mobile phone, comprises, among other things, a processor coupled to a memory and to a transceiver, each enclosed in a housing. A mobile power source, such as a battery, is coupled to and supplies power to the processor, the memory and the transceiver. A speaker and a microphone are also enclosed within the housing for transmitting and receiving, respectively, acoustic signals to and from a user of the wireless communication device. The wireless communication device communicates information by transmitting and receiving electromagnetic ("EM") energy in the radio frequency ("RF") band via an antenna coupled to the transceiver.

More recently, the demand for wireless communication devices to operate in a plurality of frequency ranges has grown. Multiple antennas, each capable of resonating at a different frequency range could be provided in such wireless communication devices for this purpose. However, multiple antennas necessitate increased material and manufacturing costs, which are undesirable. Consequently, multi-band antenna structures capable of resonating at a number of frequencies are strongly needed.

Traditionally, known multi-band antenna structures consume significant area and space within the wireless device. This results in large wireless communication devices, which are contrary to current consumer demand for smaller, more portable wireless communication devices. Other known multi-band antenna structures require expensive and space consuming matching circuits to provide support for the required frequency ranges, thereby further increasing material and manufacturing costs of such wireless communication devices.

SUMMARY OF THE INVENTION

A printed monopole multi-band antenna for wireless communication devices is disclosed which addresses and resolves one or more of the disadvantages associated with conventional multi-band antennas, as discussed above.

By way of illustration, an exemplary multi-band antenna comprises a common radiator element, a first radiator arm connected to the common radiator element and a second radiator arm connected to the common radiator element. The multi-band antenna typically comprises conductive material printed on a housing of a wireless communication device or printed on a printed circuit board situated within the housing. In another embodiment, the multi-band antenna may comprise a stamped metal sheet which is heat staked or otherwise attached to the housing or other support structure. In this way, the multi-band antenna can be tuned such that the first radiator arm is capable of resonating at a first frequency range and at a second frequency range, and the second radiator arm is capable of resonating at a third frequency range. According to one particular embodiment, the second frequency range and the third frequency range are close in proximity. In one embodiment, the second frequency range overlaps with the third frequency range.

Such an arrangement results in the desirable effect of shifting the resonance of the first and second radiator arms, thereby allowing the multi-band antenna to be tuned to desired frequency ranges. For example, the first frequency range may be approximately 824 to 894 MHz, the second frequency range may be approximately 1565 to 1585 MHz, and the third frequency range may be approximately 1850 to 1990 MHz. Effectively, the 1565 to 1585 MHz range and the 1850 to 1990 MHz range operate as a combined wide band range.

According to one particular embodiment, the first radiator arm comprises a plurality of segments connected in series, at least one of the plurality of segments angled with respect to another one of the plurality of segments. For example, the first radiator arm may include a first segment connected to the common radiator element, a second segment connected to the first segment, a third segment connected to the second segment, and a fourth segment connected to the third segment, wherein the first, second, third and fourth segments of the first radiator arm are arranged to fold around the second radiator arm along substantially a single plane, thereby improving area consumption efficiency. Typically, electromagnetic coupling between the second radiator arm and at least one of the first, second, third and fourth segments of the first radiator arm contributes to or otherwise affects the resonance of the first radiator arm.

According to various embodiments of the invention, one or more of the following benefits may be realized by the multi-band antenna including, for example, reduced manufacturing costs, reduced area consumption, reduced device size, and improved multiple frequency band support. For example, according to one embodiment, expensive and area consuming matching circuits are not required to provide tri-band support.

Other features and advantages of the present invention will become more readily apparent to those of ordinary skill in the art after reviewing the following detailed description and accompanying drawings.

DETAILED DESCRIPTION OF THE INVENTION

Figure 1:
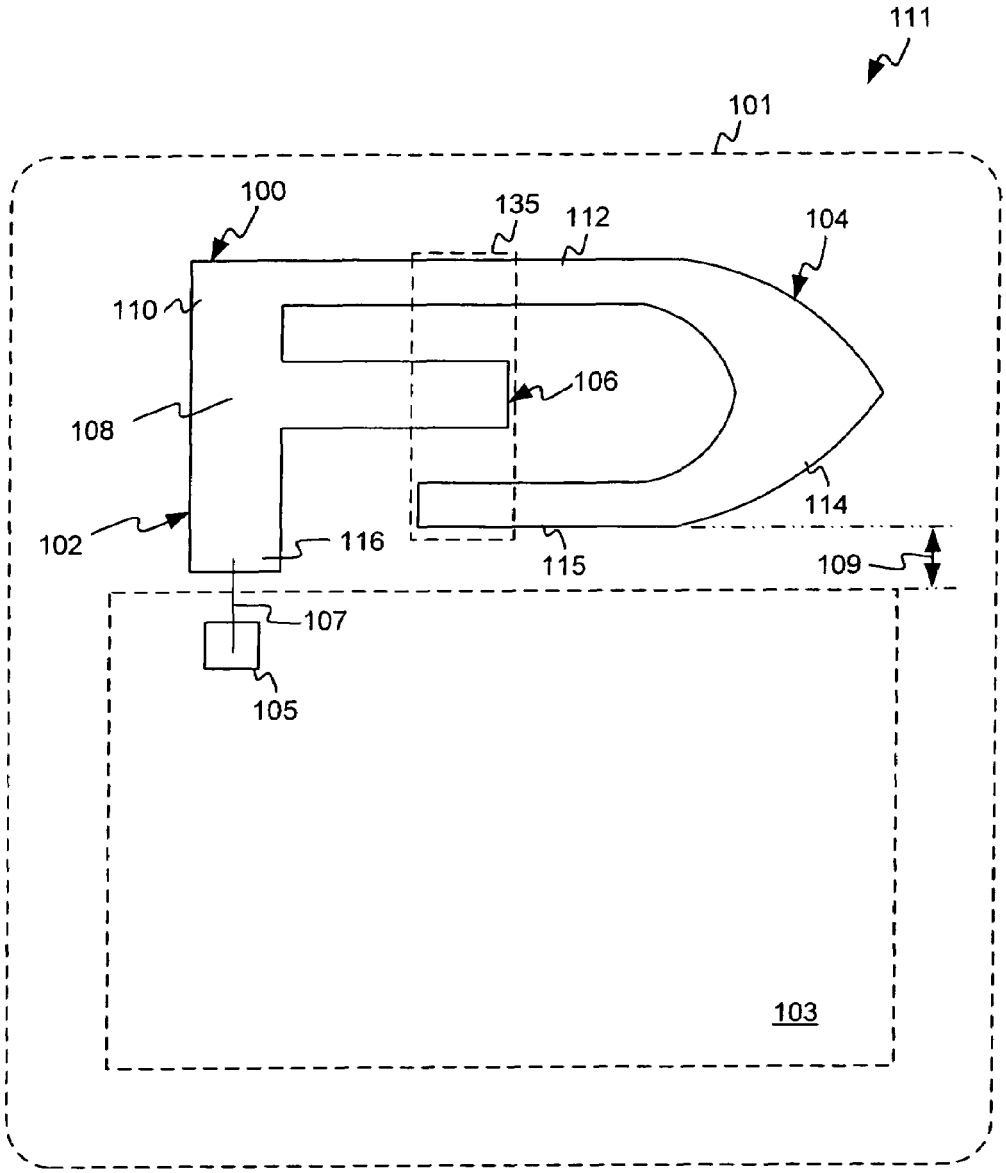
FIG. 1 illustrates an exemplary multi-band antenna printed on a housing of a wireless communication device according to one embodiment of the present invention.

Referring first to FIG. 1, there is shown exemplary multi-band antenna 100 printed on housing 101 of wireless communication device 111 according to one embodiment of the present invention. By way of example, wireless communication device 111 may be a mobile phone capable of communicating RF signals in one or more frequency bands. According to one particular embodiment, multi-band antenna 100 is capable of resonating in the cellular (or Advance Mobile Phone Service ("AMPS")) band of 824 to 894 megahertz (MHz), the Personal Communication Service ("PCS") band of 1850 to 1990 MHz, and receiving global positional satellite ("GPS") signals in the band of 1565 to 1585 MHz.

As shown in FIG. 1, multi-band antenna 100 is printed on housing 101. More particularly, multi-band antenna 100 comprises a folded monopole antenna comprising common radiator element 102, first radiator arm 104 and second radiator arm 106. Each of common radiator element 102, first radiator arm 104 and second radiator arm 106 comprise a conductive strip printed on housing 101, e.g., printed on the interior surface of housing 101. According to an alternative embodiment, common radiator element 102, first radiator arm 104 and second radiator arm 106 may be printed on a circuit board and situated within housing 101. As discussed above, in another embodiment, the multi-band antenna may comprise a stamped metal sheet which is heat staked or otherwise attached to the housing or other support structure.

Feed point 116 of multi-band antenna 100 at first end of common radiator element 102 is connected to pad 105 via line 107. Pad 105 may be situated on a printed circuit board (not shown) and connected to a transceiver of wireless communication device 111 for communicating RF signals via multi-band antenna 100. Junction 108 at second end of common radiator element 102 connects common radiator element 102 to first ends of first radiator arm 104 and second radiator arm 106, respectively. Second ends of first radiator arm 104 and second radiator arm 106, respectively, are unterminated as shown in FIG. 1. The distance between each of first radiator arm 104 and second radiator arm 106 to ground plane 103 generally indicated by dimension 109 is typically at least 10 millimeters (mm).

Continuing with FIG. 1, first radiator arm 104 comprises segments 110, 112, 114 and 115. In this way, first radiator arm 104 is folded, thereby reducing the area occupied by multi-band antenna 100. In the particular arrangement depicted in FIG. 1, first radiator arm 104 is configured to have a first resonance at a first frequency range and a second resonance at a second frequency range, and second radiator arm 106 is configured to resonate at a third frequency range. It is noted that the electromagnetic coupling between first radiator arm 104 and second radiator arm 106, generally within dashed region 135, contributes to the resonance of first radiator arm 104, e.g., for resonating at the second frequency range.

Figure 2:
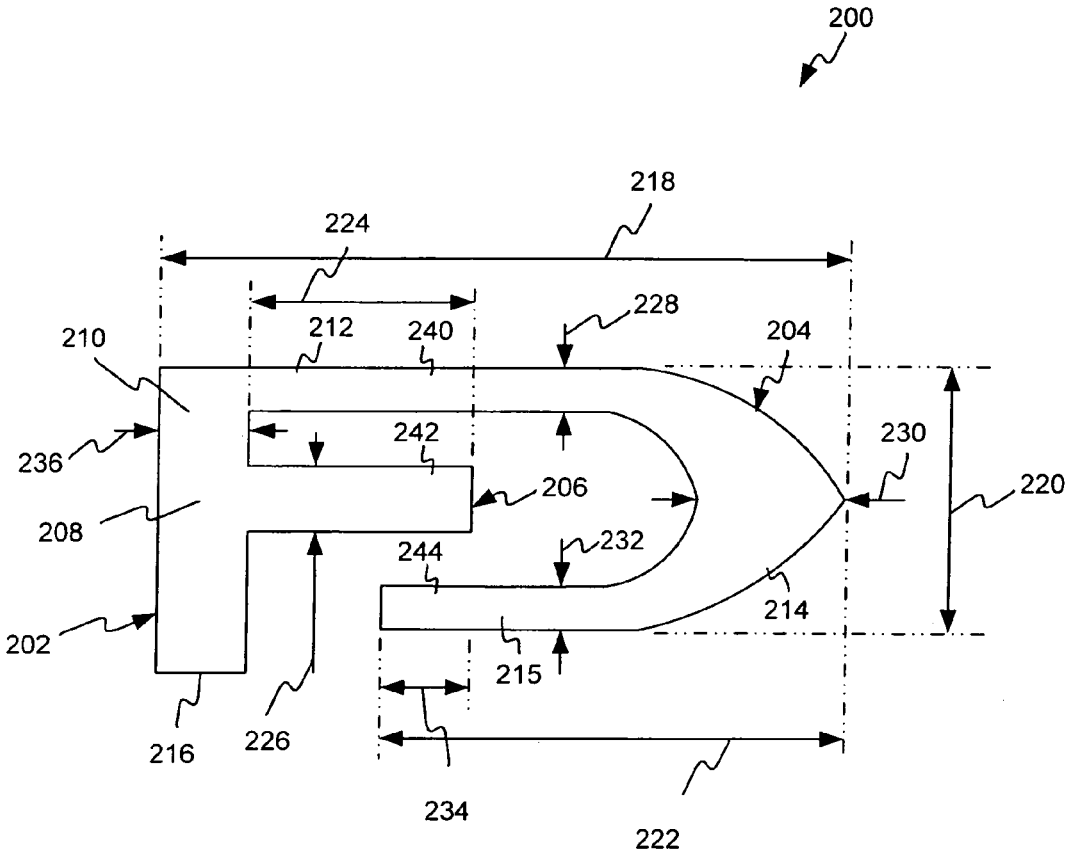
FIG. 2 illustrates an exemplary multi-band antenna according to one embodiment of the present invention.

Referring now to FIG. 2, exemplary multi-band antenna 200 according to one embodiment of the present invention is shown. In FIG. 2, multi-band antenna 200 corresponds to one particular embodiment of multi-band antenna 100 of FIG. 1, where common radiator element 202, first radiator arm 204 and second radiator arm 206 correspond to common radiator element 102, first radiator arm 104 and second radiator arm 106, respectively, of multi-band antenna 100. As discussed below, due to the particular arrangement of multi-band antenna 200, an inexpensive and efficient internal antenna capable of resonating in the cellular (or AMPS) band of 824 to 894 MHz, the PCS band of 1850 to 1990 MHz, and receiving GPS signals in the band of 1565 to 1585 MHz is provided. It is noted that for ease of illustration, multi-band antenna 200 is not drawn to scale.

In FIG. 2, feed point 216 of multi-band antenna 200 at first end of common radiator element 202 is capable of being connected to a transceiver of a wireless communication device, as discussed above in conjunction with multi-band antenna 100. Junction 208 at second end of common radiator element 202 connects common radiator element 202 to first ends of first radiator arm 204 and second radiator arm 206, respectively. Second ends of first radiator arm 204 and second radiator arm 206, respectively, are unterminated.

In the particular embodiment shown in FIG. 2, first radiator arm 204 comprises segments 210, 212, 214 and 215 connected in series and folded around second radiator arm 206 and lying on substantially the same plane. Such an arrangement significantly reduces the amount of area consumed by multi-band antenna 200. Dimension 236 defining the width of segment 210 of first radiator arm 204 is approximately 4 mm. Dimension 228 defining the width of segment 212 is approximately 3.8 mm, and dimension 218 defining the length of segment 212 is approximately 41 mm. Dimension 230 defining the width of segment 214 at an approximate midway point between segments 212 and 215 is approximately 7.2 mm, and dimension 220 generally corresponding to the length of segment 214 is approximately 12.3 mm. Dimension 232 defining the width of segment 215 is approximately 3.7 mm, and dimension 222 defining the length of segment 215 is approximately 26 mm. Dimension 226 defining the width of second radiator arm 206 is approximately 4.7 mm, and dimension 224 defining the length of second radiator arm 206 is approximately 14.6 mm.

The particular arrangement of multi-band antenna 200 results in electromagnetic coupling between portion 240 of segment 212, portion 244 of segment 215, and portion 242 of second radiator arm 206, generally within overlap region 234. Consequently, the resonance of first radiator arm 204 and the resonance of second radiator arm 206 can be shifted/adjusted, thereby allowing tuning of multi-band antenna 100 to desired frequency ranges. According to one particular embodiment, the second frequency range and the third frequency range are close in proximity. In this way, first radiator arm 204 is capable of being tuned to resonate in the cellular (or AMPS) band of 824 to 894 MHz and in a second frequency ranging corresponding to the GPS band of 1565 to 1585 MHz, while second radiator arm 206 is capable of being tuned to resonate in the PCS band of 1850 to 1990 MHz.

According to this particular embodiment, expensive and space consuming matching circuits are not required to achieve the performance of multi-band antenna 200 in these frequency ranges. Moreover, multi-band antenna 200 achieves these benefits without multiple and costly external antennas thereby further improving the portability of a wireless communication device incorporating multi-band antenna 200.

Figure 3:
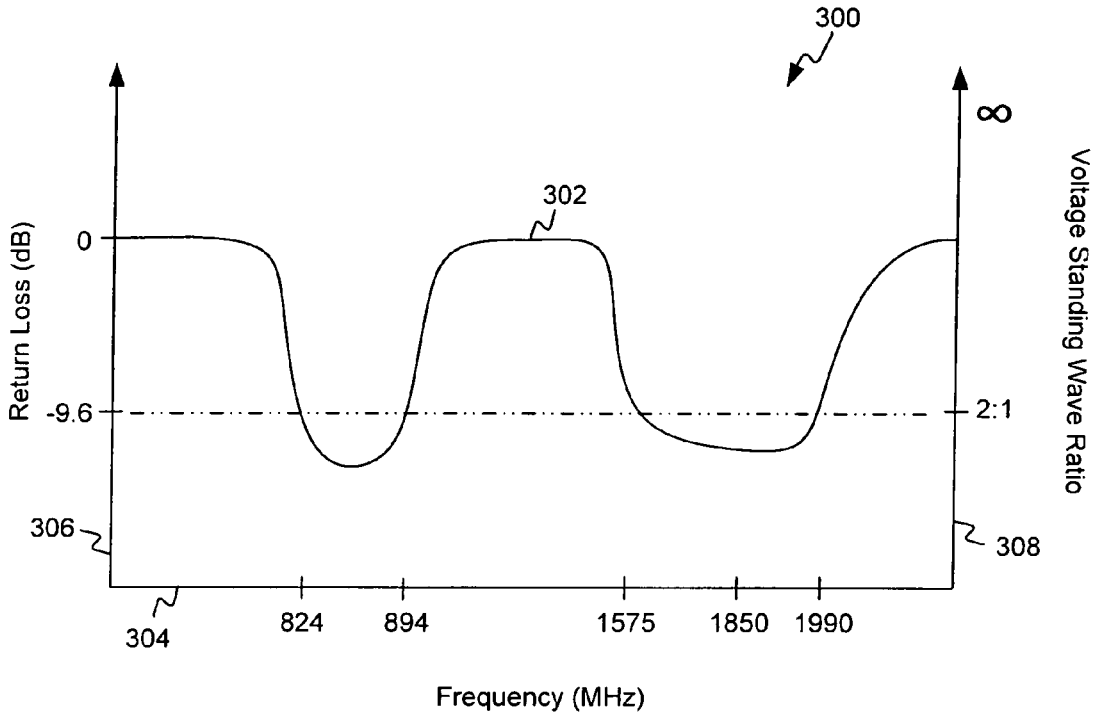
FIG. 3 illustrates a graph depicting exemplary radiation characteristics of the multi-band antenna of FIG. 2 according to one embodiment of the present invention.

FIG. 3 illustrates graph 300 depicting curve 302 corresponding to the radiation characteristics of multi-band antenna 200 according to the embodiment discussed above in conjunction with FIG. 2. In graph 300, horizontal axis 304 defines frequency in MHz, while first veritcal axis 306 defines return loss ("RL") in decibels (dB) and second vertical axis 308 defines the voltage standing wave ratio ("VSWR"). Each of RL and VSWR provide an accurate measure of radiation performance of an antenna in particular frequency ranges. As illustrated by curve 302, multi-band antenna 200 has significantly reduced return loss in the cellular (or AMPS) band of 824 to 894 MHz, the GPS band of 1565 to 1585 MHz and the PCS band of 1850 to 1990 MHz, corresponding to good radiation performance in the respective frequency regions. Likewise, multi-band antenna 200 exhibits good VSWR ratio (approximately 2:1) in the cellular (or AMPS) band of 824 to 894 MHz, the GPS band of 1565 to 1585 MHz and the PCS band of 1850 to 1990 MHz, corresponding to good radiation performance in the same frequency regions. As discussed above, the resonance of first radiator arm 204 and the resonance of second radiator arm 206 effectively achieve a combined single wide range in the range of approximately 1565 to 1990 MHz.

From the above description of exemplary embodiments of the invention, it is manifest that various techniques can be used for implementing the concepts of the present invention without departing from its scope. Moreover, while the invention has been described with specific reference to certain embodiments, a person of ordinary skill in the art would recognize that changes could be made in form and detail without departing from the spirit and the scope of the invention. For example, the specific layout arrangement of first radiator arm and second radiator arm of the multi-band antenna could be modified from that discussed above without departing from the scope of the invention. The described exemplary embodiments are to be considered in all respects as illustrative and not restrictive. It should also be understood that the invention is not limited to the particular exemplary embodiments described herein, but is capable of many rearrangements, modifications, and substitutions without departing from the scope of the invention.

What is claimed is:

1. An antenna capable of being connected to a transceiver for resonating at a plurality of frequency bands, the antenna comprising:

a common radiator element;

a first radiator arm connected to the common radiator element;

a second radiator arm connected to the common radiator element and positioned to allow electromagnetic coupling between the first radiator arm and the second radiator arm, the first radiator arm capable of resonating at a first frequency range and at a second frequency range, the second radiator arm capable of resonating at a third frequency range.

2. The antenna of claim 1, wherein the electromagnetic coupling between the first radiator arm and the second radiator arm shifts the resonance of the first radiator arm in the second frequency range.

3. The antenna of claim 2, wherein the second frequency range is in close proximity to the third frequency range, wherein electromagnetic coupling between the first radiator arm and the second radiator arm results in the second frequency range and the third frequency range providing a combined frequency range.

4. The antenna of claim 2, wherein the second frequency range overlaps with the third frequency range.

5. The antenna of claim 2, wherein each of the common radiator element, the first radiator arm and the second radiator arm comprises a printed conductive strip.

6. The antenna of claim 2, wherein each of the common radiator element, the first radiator arm and the second radiator arm comprises a stamped metal sheet.

7. The antenna of claim 2, wherein the first frequency range comprises approximately 824 to 894 MHz, the second frequency range comprises approximately 1565 to 1585 MHz, and the third frequency range comprises approximately 1850 to 1990 MHz, wherein electromagnetic coupling between the first radiator arm and the second radiator arm results in the second frequency range and the third frequency range providing a combined frequency range of approximately 1565 to 1990 MHz.

8. The antenna of claim 2, wherein the common radiator element has a first end capable of being connected to the transceiver and a second end connected to respective first ends of the first radiator arm and the second radiator arm, wherein respective second ends of the first radiator arm and the second radiator arm are unterminated.

9. An antenna capable of being connected to a transceiver for resonating at a plurality of frequency bands, the antenna comprising:

a common radiator element;

a first radiator arm connected to the common radiator element, the first radiator arm comprising a plurality of segments connected in series, at least one of the plurality of segments angled with respect to another one of the plurality of segments;

a second radiator arm connected to the common radiator element and positioned to allow electromagnetic coupling between the first radiator arm and the second radiator arm, the first radiator arm capable of resonating at a first frequency range and at a second frequency range, the second radiator arm capable of resonating at a third frequency range.

10. The antenna of claim 9, wherein the plurality of segments comprises a first segment connected to the common radiator element, a second segment connected to the first segment, a third segment connected to the second segment, and a fourth segment connected to the third segment, wherein the electromagnetic coupling is between the second radiator arm and at least one of the first, second, third and fourth segments and shifts the resonance of the first radiator arm in the second frequency range.

11. The antenna of claim 10, wherein the second frequency range is in close proximity to the third frequency range, wherein electromagnetic coupling between the first radiator arm and the second radiator arm results in the second frequency range and the third frequency range providing a combined frequency range.

12. The antenna of claim 10, wherein the first, second, third and fourth segments of the first radiator arm are arranged to fold around the second radiator arm along substantially a single plane.

13. The antenna of claim 10, wherein the first frequency range comprises approximately 824 to 894 MHz, the second frequency range comprises approximately 1565 to 1585 MHz, and the third frequency range comprises approximately 1850 to 1990 MHz, wherein electromagnetic coupling between the first radiator arm and the second radiator arm results in the second frequency range and the third frequency range providing a combined frequency range of approximately 1565 to 1990 MHz.

14. The antenna of claim 10, wherein the common radiator element has a first end capable of being connected to the transceiver and a second end connected to respective first ends of the first radiator arm and the second radiator arm, wherein respective second ends of the first radiator arm and the second radiator arm are unterminated.

15. A wireless communication device comprising:

a housing;

a transceiver situated in the housing, the transceiver coupled to an antenna for transmitting and receiving radio frequency signals in a plurality of frequency bands;

a mobile power source supplying power to the transceiver, the antenna comprising: a common radiator element, a first radiator arm connected to the common radiator element, a second radiator arm connected to the common radiator element and positioned to allow electromagnetic coupling between the first radiator arm and the second radiator arm, the first radiator arm capable of resonating at a first frequency range and at a second frequency range, the second radiator arm capable of resonating at a third frequency range.

16. The device of claim 15, wherein electromagnetic coupling between the first radiator arm and the second radiator arm shifts the resonance of the first radiator arm in the second frequency range.

17. The device of claim 16, wherein the first frequency range comprises approximately 824 to 894 MHz, the second frequency range comprises approximately 1565 to 1585 MHz, and the third frequency range comprises approximately 1850 to 1990 MHz, wherein the electromagnetic coupling between the first radiator arm and the second radiator arm results in the second frequency range and the third frequency range providing a combined frequency range of approximately 1565 to 1990 MHz.

18. The device of claim 16, wherein the common radiator element has a first end connected to the transceiver and a second end connected to respective first ends of the first radiator arm and the second radiator arm, wherein respective second ends of the first radiator arm and the second radiator arm are unterminated.

19. The device of claim 16, wherein the second frequency range is in close proximity to the third frequency range, wherein electromagnetic coupling between the first radiator arm and the second radiator arm results in the second frequency range and the third frequency range providing a combined frequency range.

20. The device of claim 16, wherein the second frequency range overlaps with the third frequency range.

* * * * *